US009057498B2

(12) United States Patent
Nall et al.

(10) Patent No.: US 9,057,498 B2
(45) Date of Patent: Jun. 16, 2015

(54) LED LIGHT MODULE FOR BACKLIGHTING

(75) Inventors: Jeffrey Marc Nall, Brecksville, OH (US); Tyler Rolfes, Cleveland, OH (US); Brian Spahnie, Brunswick, OH (US); Suping Wang, ShangHai (CN)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 232 days.

(21) Appl. No.: 13/434,079

(22) Filed: Mar. 29, 2012

(65) Prior Publication Data

US 2013/0042510 A1 Feb. 21, 2013

Related U.S. Application Data

(60) Provisional application No. 61/523,590, filed on Aug. 15, 2011.

(51) Int. Cl.

| | |
|---|---|
| ***F21V 5/00*** | (2006.01) |
| ***G09F 13/00*** | (2006.01) |
| ***F21V 5/04*** | (2006.01) |
| ***G09F 13/22*** | (2006.01) |
| ***G09F 13/04*** | (2006.01) |

(52) U.S. Cl.

CPC . *F21V 5/04* (2013.01); *G09F 13/22* (2013.01); *G09F 13/0404* (2013.01); *G09F 2013/222* (2013.01)

(58) Field of Classification Search

CPC ..... G09F 13/00; G09F 13/0404; G09F 13/06; G09F 13/22; G09F 2013/222; H05B 33/00; G02F 1/133606; F21S 6/002; F21S 4/0003; F21S 48/1233; F21V 9/10; F21V 5/04; F21W 2121/00

USPC ..... 40/551, 552, 564, 544; 362/242, 244, 362/246, 311.06, 311.09, 311.1, 335

See application file for complete search history.

(56) References Cited

U.S. PATENT DOCUMENTS

| | | | | |
|---|---|---|---|---|
| 6,485,160 | B1 | 11/2002 | Sommers et al. | |
| 7,241,031 | B2 * | 7/2007 | Sloan et al. | 362/373 |

(Continued)

FOREIGN PATENT DOCUMENTS

| | | | |
|---|---|---|---|
| JP | 61214000 | | 9/1986 |
| JP | 2008103300 | A | 5/2008 |

OTHER PUBLICATIONS

Sign Builder Illustrated, "SloanLED Introduces Revolutionary Technology for Low-Profile Signs", pp. 34-35, Apr. 2011.

(Continued)

*Primary Examiner* — Joanne Silbermann
(74) *Attorney, Agent, or Firm* — Pearne & Gordon LLP

(57) ABSTRACT

An LED light module and a backlit sign using at least one of the LED light modules are described. The LED light module comprises at least two LED light sources that are spaced apart from each other. Each of the LED light sources is covered by a lens and at least two of the lenses have a different shape than each other. The LED light module produces a uniform intensity of light on a backlit surface. The LED light module can include three LED light sources. Two of the lenses covering the LED light sources emit light that is distributed off-axis and a third of the lenses covering the LED light sources emits light that is distributed substantially on-axis. The backlit sign comprises a housing, at least one LED light module disposed in the housing and a backlit surface on the housing extending over the LED modules.

33 Claims, 6 Drawing Sheets

(56) References Cited

U.S. PATENT DOCUMENTS

| | | | | |
|---|---|---|---|---|
| 7,461,948 | B2 * | 12/2008 | van Voorst Vader et al. | 362/244 |
| 7,832,896 | B2 | 11/2010 | Saha et al. | |
| 2003/0053310 | A1 | 3/2003 | Sommers | |
| 2009/0056183 | A1 * | 3/2009 | Reiland et al. | 40/564 |
| 2009/0211130 | A1 * | 8/2009 | Hoffman et al. | 40/541 |
| 2010/0073783 | A1 | 3/2010 | Sun | |
| 2011/0157891 | A1 * | 6/2011 | Davis et al. | 362/244 |

OTHER PUBLICATIONS

Sign & Digital Graphics, "Sign Technology", pp. 72-73, Apr. 2011.
Search Report and Written Opinion dated Sep. 18, 2013 from corresponding EP Appiication No. 12179956.3.

* cited by examiner

Maximum Candela = 9.1 Located At Horizontal Angle = 0, Vertical Angle = 0
1 - Vertical Plane Through Horizontal Angles (0 = 180) (Through Max. Cd.)
2 - Horizontal Cone Though Vertical Angle (0) (Through Max. Cd.)

LED LIGHT MODULE FOR BACKLIGHTING

CROSS-REFERENCE TO RELATED APPLICATIONS

This application claims the benefit of U.S. Provisional Application No. 61/523,590, filed on Aug. 15, 2011, the entire disclosure of which is hereby incorporated herein by reference.

FIELD OF THE INVENTION

The present invention relates to LED lighting, and more particularly, LED lighting of shallow depth backlit surfaces.

BACKGROUND OF THE INVENTION

Various lighting methods are used to light surfaces from the opposite side from which they are normally viewed. For various reasons, light emitting diode (LED) devices are being used more frequently, and this includes backlit light transmissive surfaces such as illuminated signage, point of purchase displays for retailers, flat or shallow panel illumination fixtures, decorative lighting applications, and the like. Size or space limitations of the fixture assembly may limit the distance between the backlit surface and a rear surface upon which an LED device is mounted. These shallow applications require the LED device to distribute emitted light at wide angles in order to illuminate the entire backlit surface within the shallow distance. Without the use of wide viewing angle lenses, bright illumination levels on the backlit surface can create "hot spots" of non-uniform light intensity that are apparent to a viewer. Lenses are used to effect this wide angle control of the light emission. The use of only wide angle lenses with the LED devices, however, can result in some dimmer areas on the backlit surface located closest to the lens called "donut holes" because a significant portion of the light emitted is being diverted to the sides of the LED at larger angles to the illuminated portion of the backlit surface. As a result, improvements are desired for LED lighting in shallow backlit surface applications.

BRIEF SUMMARY OF THE INVENTION

In one embodiment, this disclosure features an LED light module comprising at least two LED light sources that are spaced apart from each other. Each of the LED light sources is covered by a lens, and at least two of the lenses have a different shape than each other. The lens shapes differ in a form of different internal cross-sectional profiles or similar said profiles with different light distribution patterns.

Regarding more specific features of the first embodiment, the LED light module can include three LED light sources. Two of the lenses covering the LED light sources emit light that is distributed off-axis and a third of the lenses covering the LED light sources emits light that is distributed substantially on-axis. The LED light sources can all be top emitting LEDs. Alternatively, at least one of the LED light sources can be a side emitting LED. The LED light module can include a printed circuit board on which the LED light sources are mounted. The LED light module can include an overmolded plastic body which seals together the LED light sources, the lenses, and the printed circuit board. The LED light module can include an overmolded plastic body which seals together the LED light sources and the printed circuit board while the lenses are interchangeable. The lenses may be interchangeable while the overmolding remains in place.

In a second embodiment, an LED light module includes a first LED light source and a second LED light source disposed adjacent the first LED light source. Each of the LED light sources is covered by a lens. The lens covering the first LED light source emits light that is distributed off-axis. The lens covering the second LED light source emits light that is distributed substantially on-axis. The terms off-axis and on-axis are defined in the detailed description. Light distribution patterns for light distributed off-axis and light distributed on-axis are shown in FIGS. 6 and 7, respectively. The lenses have a different shape than each other in a form of different internal cross-sectional profiles or similar said profiles with different light distribution patterns.

Regarding more specific features of the second embodiment, the lenses having different shapes than each other produce a uniform intensity of light on a backlit surface spaced apart from and covering the LED light module. Additionally, any of the specific features discussed above with regard to the first embodiment may be used in any combination in connection with this embodiment of the disclosure.

In a third embodiment, an LED light module includes a plurality of first LED light sources and at least one second LED light source disposed between at least two of the first LED light sources. Each of the LED light sources is covered by a lens. The lenses covering the first LED light sources emit light that is distributed off-axis. The lens covering the second LED light source emits light that is distributed substantially on-axis. At least two of the lenses have a different shape than each other in a form of different internal cross-sectional profiles or similar profiles with different light distribution patterns.

Regarding more specific features of the third embodiment, the LED light module produces a uniform intensity of light characterized by a less than 30% variation in a measured light intensity at any point on a straight line across the backlit surface when the LED light module is located at a 10.16 cm (4-inch) depth from the backlit surface. Additionally, any of the specific features discussed above with regard to the first and second embodiments may be used in any combination in connection with this embodiment of the disclosure.

In a fourth embodiment, a backlit sign includes a housing. The housing includes a backlit surface spaced apart from a back surface. The housing further includes at least one LED light module disposed in the housing with the backlit surface extending over the LED module.

Regarding more specific features of the fourth embodiment, the distance from the back surface to the backlit surface of the backlit sign is not more than 15.24 cm (6-inches), in particular not more than 10.16 cm (4-inches), more in particular not more than 3.81 cm (1.5-inches), and even more in particular not more than 1.27 cm (0.5-inches). Additionally, any of the specific features discussed above with regard to the previous embodiments may be used in any combination in connection with this embodiment of the disclosure.

In a fifth embodiment, a fixture includes a housing. The housing includes a backlit surface spaced apart from a back surface and multiple LED light modules disposed in the housing with the backlit surface extending over the LED light modules. Any of the specific features discussed above with regard to the previous embodiments may be used in any combination in connection with this embodiment of the disclosure.

DETAILED DESCRIPTION OF THE INVENTION

Figure 1:
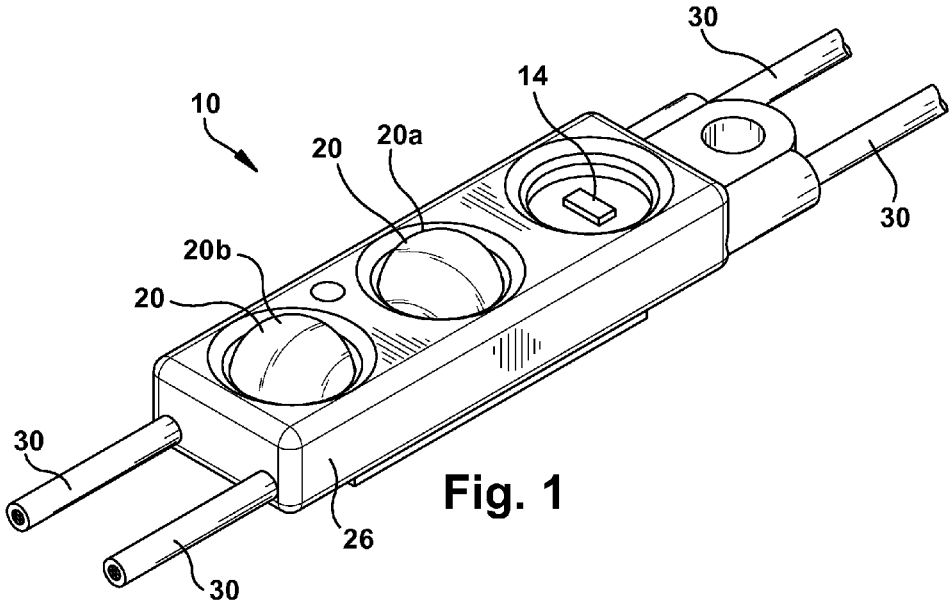
FIG. 1 is a perspective view of a Light Emitting Diode (LED) light module.

Example embodiments that incorporate one or more aspects of the invention are described and illustrated in the drawings. These illustrated examples are not intended to be a limitation on the invention. For example, one or more aspects of the invention can be utilized in other embodiments and even other types of devices. Moreover, certain terminology is used herein for convenience only and is not to be taken as a limitation on the invention. Still further, in the drawings, the same reference numerals are employed for designating the same elements.

An example embodiment of a Light Emitting Diode (LED) light module 10 is shown in FIG. 1. The LED light module 10 includes LED light sources 14 that are spaced apart from each other. The LED light sources 14 can be top emitting LEDs, side emitting LEDs, or a combination of the two. In particular, all top emitting LEDs are used in an LED light module 10. The terms top emitting LED and front emitting LED are often used interchangeably to designate a particular type of LED. For simplicity, the term top emitting LED is used herein and is meant to include the term front emitting LED. The LED light module 10 can include two LED light sources 14 or it can include three or more LED light sources 14 arranged in a straight line. The LED light module 10 can also include three or more LED light sources 14 arranged in other geometric patterns including, but not limited to, triangles, squares, circles, or unevenly spaced arrangements within a group.

Figure 2:
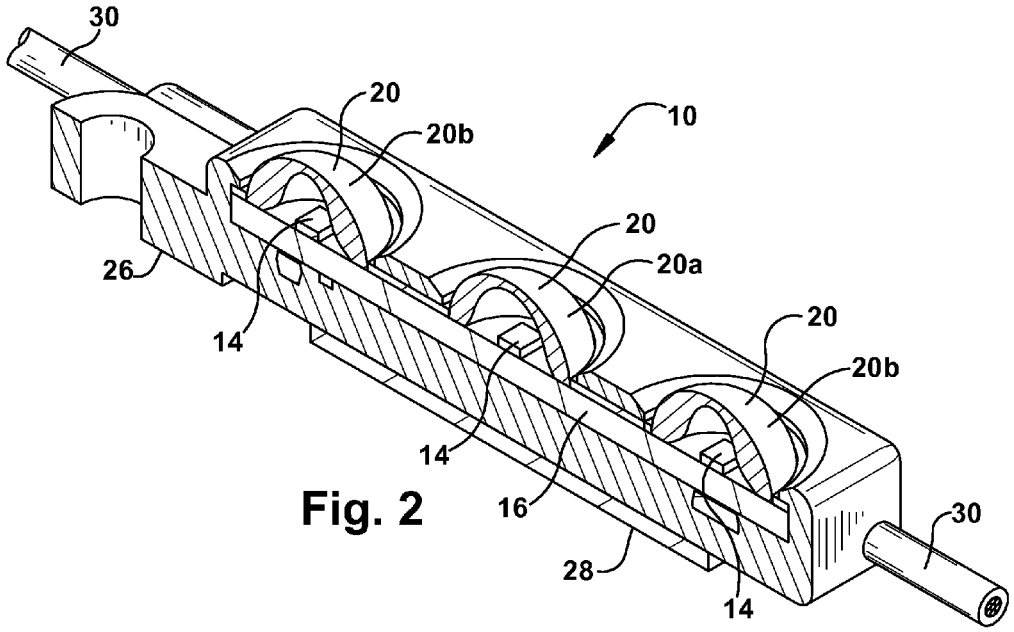
FIG. 2 is a perspective cross-sectional view of a portion of the LED light module of FIG. 1.

Turning to FIG. 2, a cross-sectional view of the example embodiment of the LED light module 10 from FIG. 1 is shown. Electric power and control elements for the LED light sources 14 can be mounted onto a printed circuit board (PCB) 16 which can also serve as a mounting surface for the LED light sources 14. Each of the LED light sources 14 is covered by a light transmitting lens 20. In one example, one lens 20 covers one LED light source 14, and in another example, one lens 20 can cover multiple LED light sources 14. The lenses 20 can be constructed of acrylic or polycarbonate material, although multiple transparent materials are contemplated.

In one embodiment, the LED light module 10 includes two outer LED light sources 14 that are spaced apart from each other and a central LED light source 14 that is disposed between the two outer LED light sources 14. Each of the LED light sources 14 is covered by a lens 20, and at least two of the lenses 20 have a different shape effective to produce a uniform intensity of light from the LED light module 10. In one example, one lens may have a cross-sectional profile that has a different shape than another lens as can be seen in the different shapes of lens 20*a* when compared to lens 20*b*. Here, the term different shapes refers to the internal cross-sectional profiles as seen from a cutting plane perpendicular to the PCB 16. The lenses 20 have different shapes to distribute the light from the individual LED light sources 14 in different patterns. While the different cross-sectional profiles are described as different shapes, it is to be appreciated that the same general shape description can apply to two different lenses and still be considered having different cross-sectional profiles or different shapes. For example, one lens 20 can have a parabolic shape with a particular center point while another lens 20 can have a parabolic shape with a different center point. When the light distribution patterns of the two lenses 20 are compared, they are different, so that the lenses 20 are considered to have different shapes. In one example, a lens 20 can have an inner surface in the shape of a dome or a Gaussian function when viewed in cross-section. It is to be appreciated that the lens shapes described in the figures are examples and are not meant to be limiting, as there are virtually endless possibilities of different shapes of lenses 20 that can be used in combination to produce a uniform intensity of light from the LED light module 10. It is also to be appreciated that the cross-section of one individual lens 20 can have an inner surface with a different shape than its outer surface, changing the angles of light emanating from the LED light source 14 to distribute the light differently than a typical Lambertian light distribution pattern (best seen in FIG. 5). A lens 20 cross-section with an inner surface and outer surface of different shapes can result in sections of varying thickness as seen in the cross-sections of lenses 20*a* and 20*b*.

In the example shown in FIG. 2, the lenses 20*b* covering the outer LED light sources 14 emit light that is substantially distributed off-axis and the lens 20*a* covering the central LED light source 14 emits light substantially on-axis. Features of an LED lighting fixture including optical elements that broaden the off-axis angle light distribution pattern from the respective LEDs are described in U.S. Pat. No. 7,832,896, entitled "LED Light Engine," which is incorporated herein by reference in its entirety.

The LED light module 10 also includes a body 26. In one example, the body can be constructed of an overmolded plastic which seals together the individual elements making up the LED light module 10, including the LED light sources 14, the lenses 20, the PCB 16, and in some cases a stand-off 28. The stand-off 28 helps ensure that the constituent parts of the LED light module 10 remain in their proper locations during the overmolding process. A section of the stand-off 28 may remain on the exterior of the body 26 after the overmolding process. Electrical leads 30 extend from the PCB at the interior of the LED light module to the exterior of the LED light module after the overmolding process. The body 26 can be used to create a sealed environment for the LED light module 10 preventing the infiltration of foreign particulates such as dust while providing moisture resistance or even a watertight condition. The body 26 may also act as a means to dissipate heat created by the LED light sources 14 via heat conduction through the PCB 16. In one example, the overmolded plastic can be a thermoplastic material, although other materials are contemplated. Additionally, other body 26 construction methods or materials other than overmolded plastic can also be used. In another example, the lenses 20 may be configured to be interchangeable rather than overmolded into the body 26. In this example, the lenses 20 can be interchanged while the overmolding remains in place.

Figure 3:
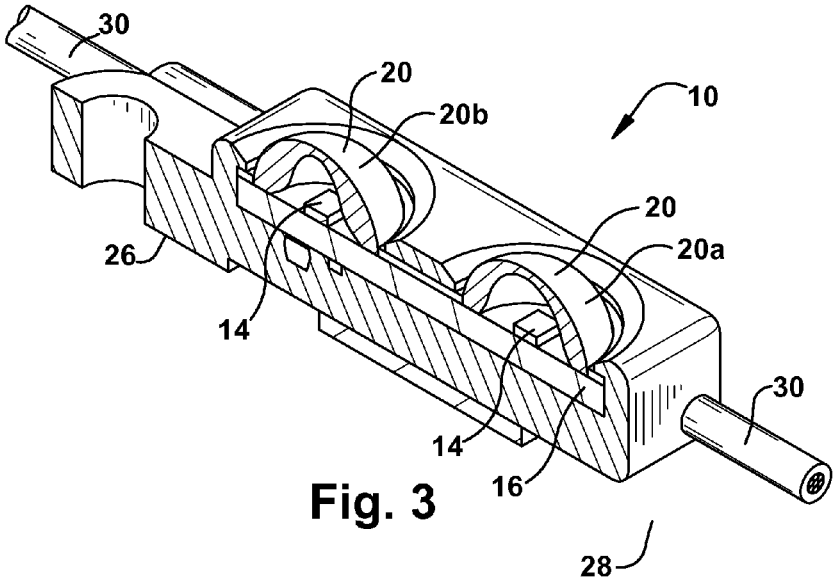
FIG. 3 is a perspective cross-sectional view of a portion of the LED light module similar to FIG. 2 with two LED light sources.

Turning to FIG. 3, a cross-sectional view of another example embodiment of a LED light module 10 is shown. The LED light module 10 includes a first LED light source 14 and a second LED light source 14 disposed adjacent the first LED light source 14. Each of the LED light sources 14 is covered by a lens 20, and both lenses 20 have a different shape than each other effective to produce a uniform intensity of light on a backlit surface. The lens 20*b* covering the first LED light source 14 emits light that is distributed off-axis. The lens 20*a* covering the second LED light source 14 emits light distributed substantially on-axis.

Figure 4A:
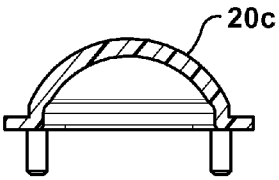
FIG. 4A is a cross-sectional view of a lens that distributes light substantially on-axis that can be used with the LED light module of FIG. 1.
Figure 4B:
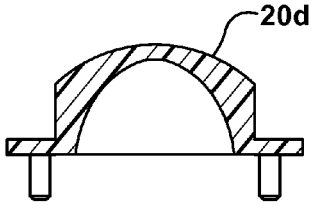
FIG. 4B is a cross-sectional view of a lens that distributes light off-axis that can be used with the LED light module of FIG. 1.
Figure 4C:
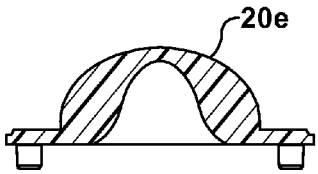
FIG. 4C is a cross-sectional view of a lens that distributes light off-axis that can be used with the LED light module of FIG. 1.
Figure 4D:
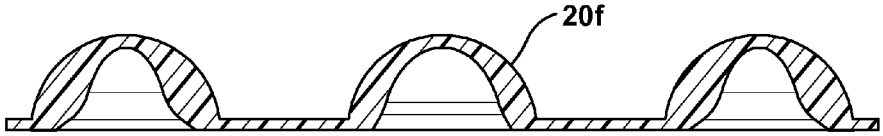
FIG. 4D is a cross-sectional view of a lens that can cover multiple LED light sources including a lens shape that distributes light substantially on-axis and lens shapes that distribute light off-axis that can be used with the LED light module of FIG. 1.

In addition to the lenses 20 shown in FIGS. 2 and 3, many additional lens designs are contemplated. FIGS. 4A-4D show cross-sectional views of other example lens designs. Turning to FIG. 4A, lens 20*c* is an example of a lens that distributes light substantially on-axis from an LED light source. Lens 20*d* of FIG. 4B is an example of a lens that distributes light off-axis from an LED light source 14. Lens 20*c* and lens 20*d* may be used with LED light module 10 to distribute light from multiple LED light sources 14 to produce a uniform intensity of light on a backlit surface. Turning to FIG. 4C, lens 20*e* is another example of a lens that distributes light off-axis from an LED light source. In another example shown in FIG. 4D, one lens 20*f* can cover multiple LED light sources 14. Lens 20*f* can include a central lens shape that distributes light substantially on-axis which differs from the two lens shapes on either side that distribute light off-axis. All three lenses may be produced in the same mold so that they are attached to one another to ensure proper spacing and ease of assembly. It is to be appreciated that multiple combinations of lenses 20*a* through 20*f* may be used with LED light module 10 to distribute light from multiple LED light sources 14 to produce a uniform intensity of light on a backlit surface.

Figure 5:
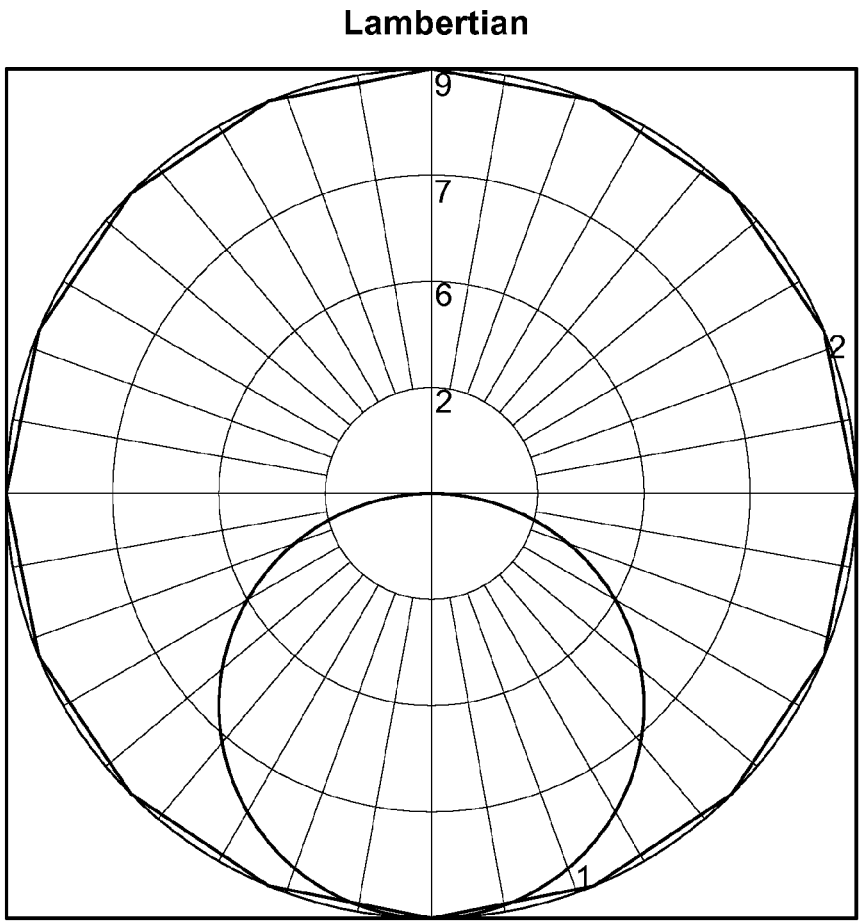
FIG. 5 is a polar plot of a light distribution pattern emitted from a Lambertian light source measured in light intensity.

For various reasons including energy conservation, LED light sources are in more frequent use. Turning to FIG. 5, a polar plot of the light path emanating from an LED light source with no lens is shown. This is a typical Lambertian light distribution pattern wherein the intensity of the light is directly proportional to the cosine of the angle from which it is viewed. In some applications, for example backlit surfaces, it is desirable to have an even light distribution across the entire backlit surface. This can be accomplished with a large amount of light sources spaced closely together, helping to ensure that no one part of the backlit surface is provided with more or less light intensity than any other part of the backlit surface. A more economical and environmentally friendly approach is to use fewer light sources in cooperation with lenses to control the path of light emanating from the light sources.

Figure 6:
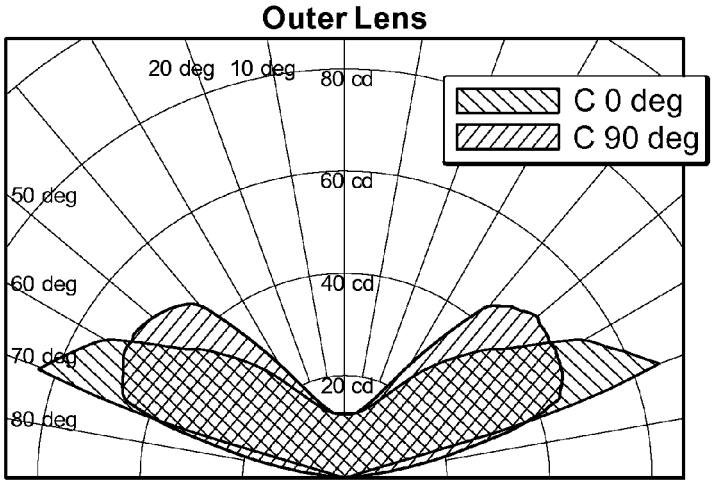
FIG. 6 is a polar plot of a light distribution pattern emitted through an outer lens used in the LED light module of FIG. 1 measured in light intensity.

In some backlit surface applications, lenses are used to control the path of light in an effort to minimize the amount of LED light sources while still providing an even light distribution across the entire backlit surface. Turning to FIG. 6, a polar plot of the light distribution pattern emanating from an LED light source controlled by a particular lens is shown. The polar plot graphically represents the amount of light measured in candelas emanating from the LED light source and lens combination versus the angle at which the light is emanating. The central vertical line on the polar plot represents the direction normal to the LED light source of 0 degrees (directly above the LED light source) while the other straight lines represent angles measured in degrees away from the vertical, or surface normal. In this case, the naming convention describes positive angles on the left of the vertical and negative angles on the right. The polar plot includes two shaded areas, the first representing the light distribution pattern on a first axis of the lens, and the other shaded area representing the light distribution pattern on the perpendicular axis to the first axis. The differences in the light distribution patterns on the two axes are not meant to be significant, and, in fact, the light distribution patterns on the two axes may be exactly the same. In some cases, the differences in the light distribution patterns on the two axes are because the emitting surface of the LED light source is asymmetrical as viewed between the horizontal and the vertical. If the emitting surface of the LED light source is symmetrical, such as a square or circle, the light distribution patterns on the two axes will tend to be exactly the same.

The particular outer lens shape developing the light distribution pattern of FIG. 6 directs light emanating from an LED light source toward the sides of the LED light source, which can be termed "off-axis" (e.g., greater light distribution in a range of 30 to 70 degrees and −30 to −70 degrees from the surface normal). This lens shape also directs light away from the space directly above the LED light source, which can be termed "on axis" (e.g., less light distribution in a range from 20 to −20 degrees from the surface normal). This lens shape creates a light distribution pattern that is sometimes termed a "batwing flare." In one example, the light distribution pattern from the LED light source and the batwing flare lens produces a particular ratio when comparing the amount of light in candelas emitted at one angle away from the vertical to the amount of light in candelas emitted on the vertical. The ratio of light distributed from the LED light source and the batwing flare lens combination can be seen in FIG. 6 to create a ratio of the off-axis illumination intensity to the on-axis illumination intensity that is greater than 2 to 1.

LED light sources and lens combinations developing a light distribution pattern as shown in FIG. 6 can be used in backlit surface applications. The lens controls the path of light to help ensure the areas of the backlit surface at greater distances from the LED light source have the same amount of light as do areas of the backlit surface which are closer to the LED light source. However, there are applications requiring the LED light sources to be a short distance from the backlit surface, for example, backlit cabinet or sign applications that are less than 4-inches deep. As distances between the backlit surface and the light sources become smaller, the batwing flare off-axis angle must increase in order to direct light to the edges of the backlit surface. At times, this redirection of the light can create a "donut hole" where the backlit surface exhibits a ring of brighter light with visibly less light in the center. This is undesirable in several applications, including lighted signs. The LED light module includes lenses of at least two different shapes to help eliminate lighting donut holes and provide an even intensity of light over the backlit surface. The different shapes of the central and outer lenses can be seen in FIG. 2 where the central lens 20*a* has an internal profile shape different from the internal profile shape of the outer lens 20*b*. The two outer lenses 20*b* of FIG. 2 have the same internal profile shape.

Figure 7:
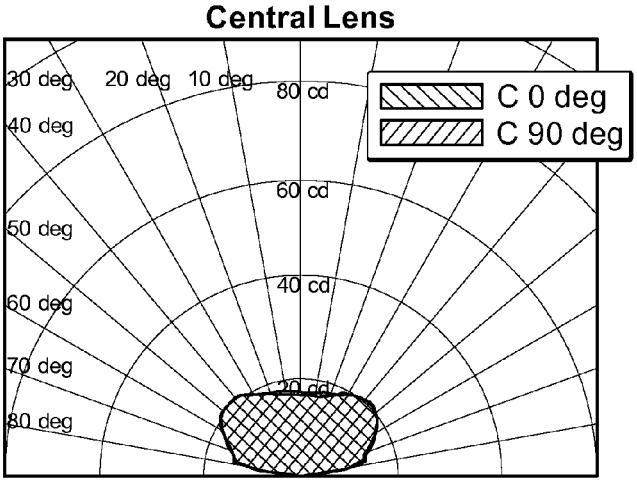
FIG. 7 is a polar plot of a light distribution pattern emitted through a central lens used in the LED light module of FIG. 1 measured in light intensity.

Turning to FIG. 7, a polar plot of the light emanating from an LED light source controlled by another example lens is shown. The described lens creates light distribution pattern as shown in the polar plot can be used as one of the lenses in the LED light module. This lens distributes light substantially on-axis. A lens producing the batwing light distribution pattern can be used as at least one of the other lenses. In one example, a lens producing the light distribution pattern in FIG. 7 can be used as the central lens in an LED light module with three LED light sources and three lenses. The two remaining (outer) lenses can be of the batwing flare profile shape. The batwing flare lenses emit light that is distributed off-axis and the central lens emits light that is distributed substantially on-axis. In one example, the light distribution pattern from the LED light source and the central lens produces a particular ratio when comparing the amount of light in candelas emitted at one angle away from the vertical to the amount of light in candelas emitted on the vertical. The ratio of light distributed from the LED light source and the central lens can be seen in FIG. 7 to create a ratio of the off-axis illumination intensity to the on-axis illumination intensity that is less than 2 to 1.

Figure 8:
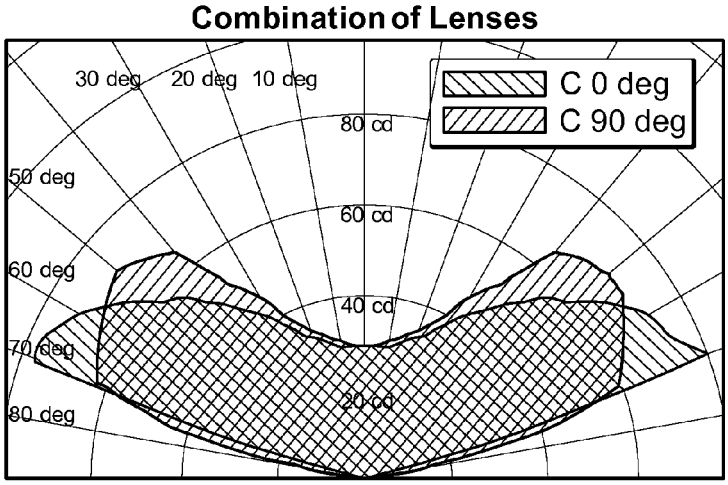
FIG. 8 is a polar plot of a light distribution pattern emitted by the LED light module of FIG. 1 using a combination of the outer lens and the central lens measured in light intensity.

The polar plot shown in FIG. 8 illustrates the improved light distribution pattern producing a uniform intensity of light with the described combination of one central and two outer lenses (best seen in FIG. 2). In one example, the light distribution pattern from the LED light sources and the described combination of lenses produces a particular ratio as measured between two different illuminated areas. The ratio of light distributed from the LED light sources and the described combination of lenses can be seen in FIG. 8 to create a ratio of the off-axis illumination intensity to the on-axis illumination intensity that is at least 2 to 1. The light distribution pattern of the outer lenses as represented in FIG. 6 in combination with the light distribution pattern of the central lens as represented in FIG. 7 achieves a more uniform intensity of light on an illuminated surface such as a backlit sign face. A uniform intensity of light can be a light distribution in which an individual LED light source cannot be distinguished from another LED light source within a backlit sign having a depth of about 10.16 cm (4-inches). A further characteristic of light with uniform intensity distribution is the avoidance of donut holes and hotspots commonly associated with lighting in backlit surface applications such as shallow backlit signs.

In another example, all of the LED light sources may be covered by one lens. The profile of the lens at the portion over the central LED light source differs from that at the portions over the other LED light sources. This has the same effect as three individual lenses where the central lens is of a different profile as the other two lenses. The light distribution from at least one of the LED light sources mixes with the light distribution from at least one of the other LED light sources. This light pattern mixing helps ensure a uniform intensity of light reaching the backlit surface. Additionally, the light pattern mixing helps neutralize any small variations in the colors of the LED light sources. Furthermore, the combination of the directed light from the LED light sources produces a uniform intensity of light such that the individual light sources cannot be determined from the opposite side of the backlit surface.

Figure 9:
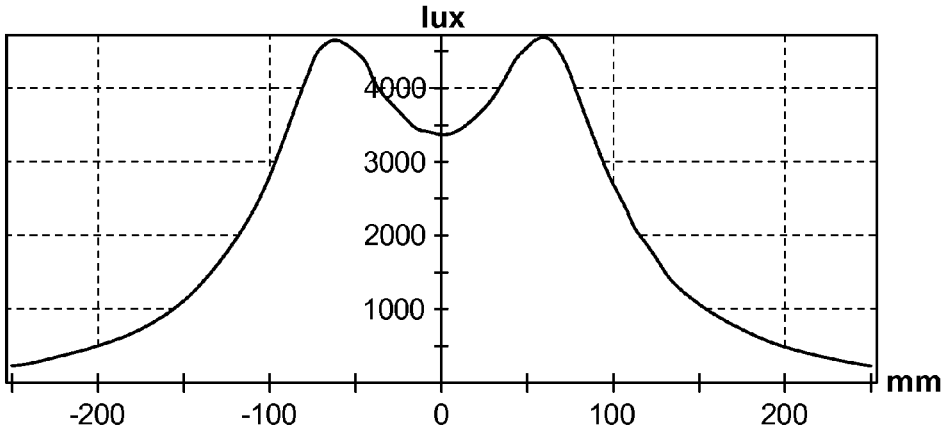
FIG. 9 is a rectilinear plot of lux (luminous intensity) versus millimeters distant from the center of the LED light module for the light emitted from three outer lenses used together in the light module of FIG. 1.
Figure 10:
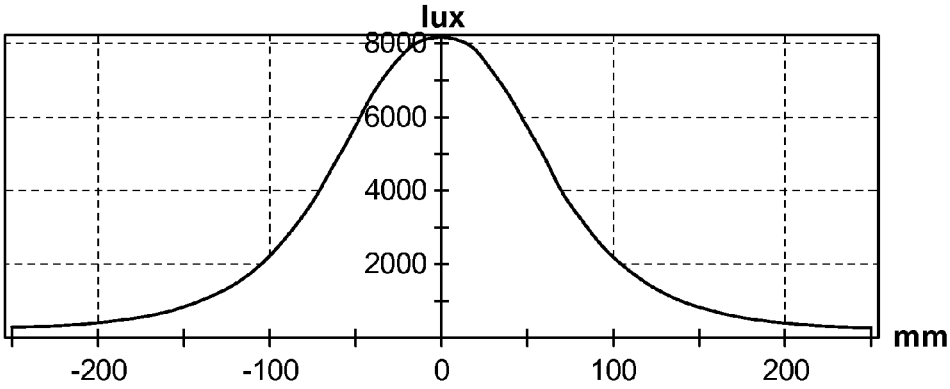
FIG. 10 is a rectilinear plot of lux versus millimeters distant from the center of the LED light module for the light emitted from three central lenses used together in the light module of FIG. 1.
Figure 11:
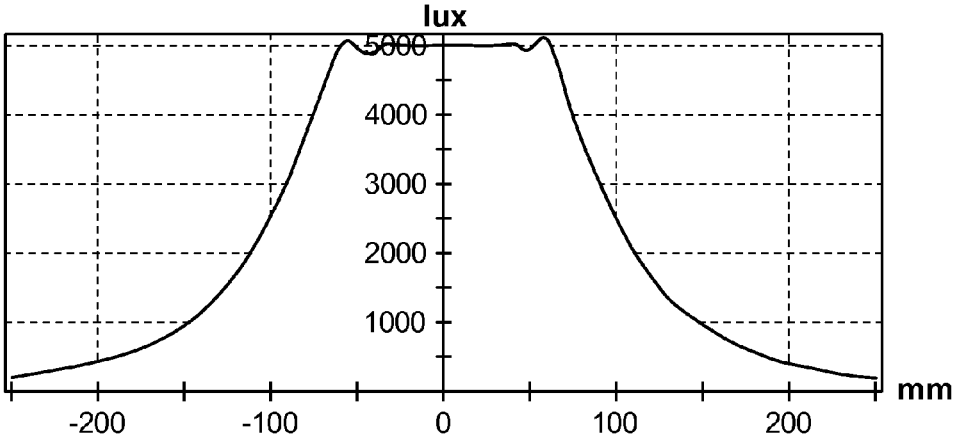
FIG. 11 is a rectilinear plot of lux versus millimeters distant from the center of the LED light module for the light emitted from a combination of one central lens and two outer lenses used together in the light module of FIG. 1.

Turning to FIGS. 9-11, rectilinear plots of lux (luminous intensity) versus millimeters distant from the center of the LED light module are shown. Here, the center of the LED light module is defined as a line defined by the center points of the LED light sources (e.g., a centerline axis of the LED light module). In the event that the center points of a plurality of LED light sources do not create a straight line, an approximation of the centerline of the LED light module may suffice. The plot of FIG. 9 is that of an LED light module with three LED light sources and lenses. Each of the lenses is a batwing flare shaped lens distributing light from LED light sources off-axis. The two peaks and central valley in the graph serve as a quantitative measurement of the donut hole effect when using only batwing flare lenses in the LED light module. Turning to FIG. 10, the plot is that of an LED light module with three LED light sources and lenses with each of the lenses distributing the light substantially on-axis. For example, the luminous intensity shown in FIG. 10 can be produced by using three central lenses as shown in FIG. 2 to cover all three of the LED light sources in one LED light module. The graph shows a large amount of luminous intensity close to the LED centerline and much less luminous intensity elsewhere. Turning to FIG. 11, the plot represents an LED light module with three LED light sources and two different lenses; off-axis batwing flare shaped lenses over the outer LEDs and the central, on-axis distributing lens over the central LED. The graph shows a uniform luminous intensity at a distance away from the centerline of about 60 mm on each side with a luminous intensity of over 4,500 lux.

The combination of the different lens shapes in the LED light module tends to produce a uniform intensity of light over an area of the backlit surface. The width of this area is determined by the distance from the LED light source to the backlit surface and the angle of the directed light. In one example, referring to FIG. 8, the area of uniform intensity of light is created by an angle from the LED light sources from +40 to −40 degrees from the vertical. More preferably, the area of uniform intensity of light is created by an angle from the LED light sources from +50 to −50 degrees from the vertical. Still more preferably, the area of uniform intensity of light is created by an angle from the LED light sources from +70 to −70 degrees from the vertical.

Additionally, the combination of the different lens shapes in the LED light module tends to produce a uniform intensity of light on a backlit surface despite the wide variation in angles of light falling on the backlit surface from the plurality of LED light sources. The cosine law of illumination states that with the luminous flux output from an LED light source being relatively constant, as the angle between the LED light source and the backlit surface increases, the same flux is spread over a larger area. Because the same flux is spread over a larger area, the luminance at any point in that area decreases. In order to minimize the effect of the cosine law of illumination, the lens shape for the batwing flare directs more light to the wider off-axis angles of the light distribution pattern and progressively less light to the central, on-axis areas of light distribution pattern. In one example, the combination of the different lens shapes in the LED light module 10 can be seen to create a ratio of the off-axis illumination intensity to the on-axis illumination intensity that is numerically between the value of the same ratio of the central lens and the value of the same ratio of the batwing flare lenses.

In another example, referring again to FIG. 8, the combination of the different lens shapes in the LED light module 10 results in a light distribution pattern of at least approximately 30 candela between the angles of −20 and +20 degrees from the vertical. The combination of the different lens shapes in the LED light module 10 also results in a light distribution pattern of at least approximately 40 candela between the angles of −50 and −20 degrees from the vertical and 20 and 50 degrees from the vertical. The combination of the different lens shapes in the LED light module 10 further results in a light distribution pattern of at least approximately 60 candela between the angles of −70 and −50 degrees from the vertical and 50 and 70 degrees from the vertical.

The plots of FIGS. 6-11 represent quantitative lighting qualities of one or a combination of lenses 20 to be used in the LED light module 10, such as the lenses 20 shown in FIG. 1. A person having ordinary skill in the art will recognize that using a variety of other lens profiles such as those shown in FIG. 4 would result in different plots in FIGS. 6-11.

Figure 12:
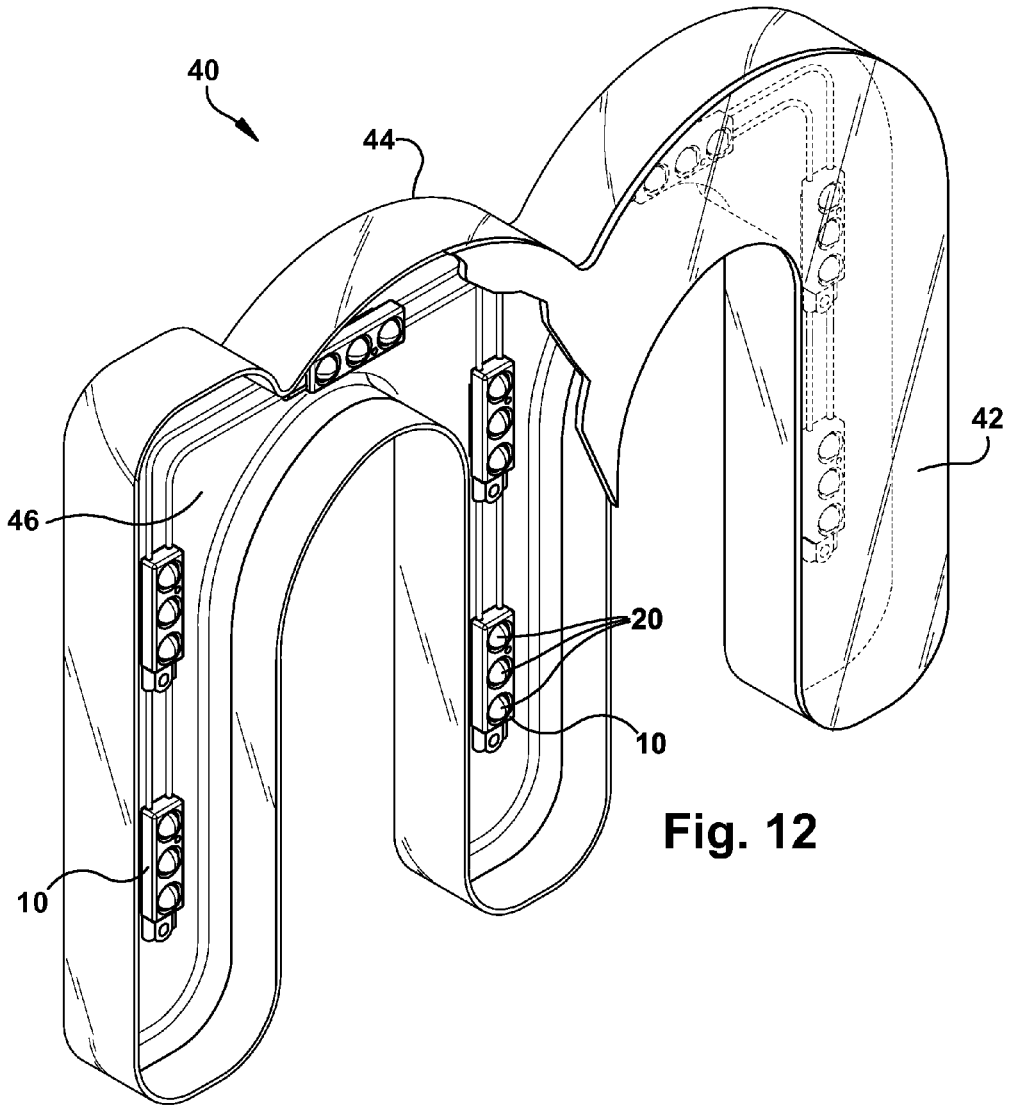
FIG. 12 is a schematic diagram of a backlit sign utilizing the LED light module of FIG. 1.

Turning to FIG. 12, a backlit sign 40 is shown with a backlit surface. In one example, the backlit surface can be a light transmitting face 42. The light transmitting face 42 is partially cut-away for illustrative purposes. The backlit sign 40 includes a housing 44 and at least one LED light module 10 disposed in the housing 44. At least two of the lenses 20 have a different shape effective to produce a uniform intensity of light on a backlit surface or plane. The backlit surface can be a light transmitting face 42 on the housing 44 extending over the LED light module 10. The LED light module 10 can be secured to a back surface 46 of the housing 44 by any method as is known in the art including, but not limited to, threaded fasteners, clips, adhesive, double-sided tape, etc. In another example, the LED light module 10 can be located between the back surface 46 and the light transmitting face 42. Various styles of sign construction and materials are contemplated so long as the LED light modules 10 are located a short distance behind the light transmitting face 42. In one backlit sign, the distance from the back surface 46 of the housing 44 to the light transmitting face 42 is not more than 15.24 cm (6-inches). In another backlit sign 40, the distance from the back surface 46 of the housing 44 to the light transmitting face 42 is not more than 10.16 cm (4-inches). In yet another backlit sign 40, the distance from the back surface 46 of the housing 44 to the light transmitting face 42 is not more than 3.81 cm (1-½ inches). It is contemplated that the distance from the back surface 46 of the housing 44 to the light transmitting face 42 can be as little as 1.27 cm (½-inch). Furthermore, the combination of the directed light from the LED light sources produces a uniform intensity of light on a backlit surface such that the individual light sources cannot be individually detected as "hot spots" from the opposite side of the backlit surface. Another indication of uniform intensity of light on a backlit surface manifests itself in a less than 30% variation in the measured light intensity at any point on a straight line across the backlit surface. A further characteristic of light with uniform intensity distribution is the avoidance of donut holes and hotspots commonly associated with lighting in backlit surface applications such as shallow backlit signs.

The described LED light module 10 provides the benefit of controlling the path of light of a plurality of LED light sources 14 in combination with different lenses 20 to provide a uniform intensity of light on a backlit surface. As the depth of the backlit sign 40 becomes more shallow, the optics of the lenses 20 are required to control the path of light to move at greater angles from the vertical. Additionally, the described LED light module 10 can encourage the use of less lighting product to deliver relatively the same amount of light to a backlit surface. In one example, a 3-inch deep backlit sign 40 can have the LED light sources 14 spaced six-inches apart, using half the lighting product typically found in a more traditional application. Furthermore, a similar approach for producing a uniform intensity of light on a backlit surface could be applicable to total internal reflection (TIR) lens designs which emit light at different output angles.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. An LED light module comprising at least two LED light sources that are spaced apart from each other, each of said LED light sources being covered by a lens, wherein at least two of said lenses have a different shape than each other in a form of different internal cross-sectional profiles or similar said profiles with different light distribution patterns, wherein one of said lenses covers a first one of said LED light sources such that emitted light is distributed off-axis and one of said lenses covers a second one of said LED light sources such that emitted light is distributed substantially on-axis, and wherein a ratio of the off-axis illumination intensity to the on-axis illumination intensity is at least 2 to 1.

2. The LED light module of claim 1, comprising three of said LED light sources.

3. The LED light module of claim 1, wherein said LED light sources are all top emitting LEDs.

4. The LED light module of claim 1, wherein at least one of said LED light sources comprises a side emitting LED.

5. The LED light module of claim 1, further comprising a printed circuit board on which said LED light sources are mounted.

6. The LED light module of claim 5, further comprising an overmolded plastic body which seals together said LED light sources, said lenses, and said printed circuit board.

7. The LED light module of claim 5, further comprising an overmolded plastic body which seals together said LED light sources and said printed circuit board wherein said lenses are interchangeable.

8. An LED light module comprising first LED light sources and at least one second LED light source disposed between at least two of said first LED light sources, said LED light sources being covered by at least one lens, wherein said at least one lens covering said first LED light sources has a different shape than said lens covering said second LED light source in a form of different internal cross-sectional profiles with different light distribution patterns, wherein said at least one lens covers said first LED light sources such that emitted light is distributed off-axis and said lens covers said second LED light source such that emitted light is distributed substantially on-axis, and wherein a ratio of the off-axis illumination intensity to the on-axis illumination intensity is at least 2 to 1.

9. The LED light module of claim 8, wherein said lenses having different shapes than each other produce a uniform intensity of light on a backlit surface spaced apart from and covering said LED light module.

10. The LED light module of claim 9, wherein said uniform intensity of light on said backlit surface is characterized by a less than 30% variation in a measured light intensity at any point on a straight line across said backlit surface when said LED light module is located at a 10.16 cm (4-inch) depth from said backlit surface.

11. The LED light module of claim 8, wherein said LED light sources are all top emitting LEDs.

12. The LED light module of claim 8, wherein said LED light sources comprise a side emitting LED.

13. The LED light module of claim 8, further comprising a printed circuit board on which said LED light sources are mounted.

14. The LED light module of claim 8, further comprising an overmolded plastic body which seals together said LED light sources, said lenses, and said printed circuit board.

15. The LED light module of claim 8, further comprising an overmolded plastic body which seals together said LED light sources and said printed circuit board wherein said lenses are interchangeable.

16. A backlit sign comprising a housing, said housing including a backlit surface spaced apart from a back surface, at least one LED light module of claim 8 disposed in said housing and said backlit surface extending over said LED module.

17. The backlit sign of claim 16, wherein said LED light module comprising lenses having different shapes than each other produces a uniform intensity of light on said backlit surface.

18. The backlit sign of claim 17, wherein said uniform intensity of light on said backlit surface is characterized by a less than 30% variation in a measured light intensity at any point on a straight line across said backlit surface when said LED light module is located at a 10.16 cm (4-inch) depth from said backlit surface.

19. The backlit sign of claim 16, wherein a distance from said back surface to said backlit surface is not more than 15.24 cm (6-inches).

20. The backlit sign of claim 16, wherein a distance from said back surface to said backlit surface is not more than 10.16 cm (4-inches).

21. The backlit sign of claim 16, wherein a distance from said back surface to said backlit surface is not more than 3.81 cm (1.5-inches).

22. The backlit sign of claim 16, wherein a distance from said back surface to said backlit surface is not more than 1.27 cm (0.5-inches).

23. A fixture comprising a housing, said housing including a backlit surface spaced apart from a back surface, multiple said LED light modules of claim 8 disposed in said housing and said backlit surface extending over said LED light modules.

24. The fixture of claim 23, wherein said LED light module comprising lenses having different shapes than each other produces a uniform intensity of light on said backlit surface.

25. The fixture of claim 24, wherein said uniform intensity of light on said backlit surface is characterized by a less than 30% variation in a measured light intensity at any point on a straight line across said backlit surface when said LED light module is located at a 10.16 (4-inch) depth from said backlit surface.

26. The fixture of claim 23, wherein a distance from said back surface to said backlit surface is not more than 15.24 cm (6-inches).

27. The fixture of claim 23, wherein a distance from said back surface to said backlit surface is not more than 10.16 cm (4-inches).

28. The fixture of claim 23, wherein a distance from said back surface to said backlit surface is not more than 3.81 cm (1.5-inches).

29. The fixture of claim 23, wherein a distance from said back surface to said backlit surface is not more than 1.27 cm (0.5-inches).

30. The LED light module of claim 8 wherein said at least one lens covering said first LED light sources includes two lenses having the same internal cross-sectional profile, and said two lenses and said lens covering said second LED light source, are integrally formed as one piece.

31. An LED light module comprising first LED light sources and at least one second LED light source disposed between at least two of said first LED light sources, said LED light sources being covered by at least one lens, wherein said at least one lens covering said first LED light sources has a different shape than said lens covering said second LED light source in a form of different internal cross-sectional profiles with different light distribution patterns, wherein said at least one lens covers said first LED light sources such that emitted light is distributed off-axis and said lens covers said second LED light source such that emitted light is distributed substantially on-axis, and wherein a peak illumination intensity occurs at an angle of at least 50 degrees from a surface normal.

32. The LED light module of claim 31 wherein a ratio of the off-axis illumination intensity to the on-axis illumination intensity is at least 2 to 1.

33. The LED light module of claim 31 wherein said at least one lens covering said first LED light sources includes two lenses having the same internal cross-sectional profile, and said two lenses and said lens covering said second LED light source, are integrally formed as one piece.

* * * * *

UNITED STATES PATENT AND TRADEMARK OFFICE

CERTIFICATE OF CORRECTION

PATENT NO. : 9,057,498 B2
APPLICATION NO. : 13/434079
DATED : June 16, 2015
INVENTOR(S) : Nall et al.

It is certified that error appears in the above-identified patent and that said Letters Patent is hereby corrected as shown below:

In the claims

Column 10, Lines 18-19, Claim 1, delete "profiles or similar said profiles with" and insert -- profiles with --, therefor.

Signed and Sealed this
Twenty-fourth Day of November, 2015

Michelle K. Lee

Michelle K. Lee
*Director of the United States Patent and Trademark Office*